United States Patent [19]

Dunmead et al.

[11] Patent Number: 4,946,643

[45] Date of Patent: Aug. 7, 1990

[54] DENSE, FINELY, GRAINED COMPOSITE MATERIALS

[75] Inventors: Stephen D. Dunmead, Davis; Joseph B. Holt, San Jose; Donald D. Kingman, Danville; Zuhair A. Munir, Davis, all of Calif.

[73] Assignee: The United States of America as represented by the United States Department of Energy, Washington, D.C.

[21] Appl. No.: 412,973

[22] Filed: Sep. 26, 1989

Related U.S. Application Data

[62] Division of Ser. No. 260,757, Oct. 21, 1988.

[51] Int. Cl.[5] ..... B22F 1/00

[52] U.S. Cl. ..... 419/12; 419/17; 419/45; 419/63; 419/38; 419/39

[58] Field of Search ..... 419/12, 17, 38, 39, 419/45, 63

[56] References Cited

U.S. PATENT DOCUMENTS

| | | | |
|---|---|---|---|
| 3,353,954 | 11/1967 | Williams et al. | 75/201 |
| 4,155,755 | 5/1979 | Sara | 75/200 |
| 4,251,272 | 2/1981 | Sara | 75/200 |
| 4,431,448 | 2/1984 | Merzhanov et al. | 75/238 |
| 4,446,242 | 5/1984 | Holt | 501/96 |
| 4,459,363 | 7/1984 | Holt | 501/96 |
| 4,466,829 | 8/1984 | Nishigaki et al. | 75/240 |
| 4,585,618 | 4/1986 | Fresnel et al. | 419/12 |
| 4,650,519 | 3/1987 | Chang et al. | 75/246 |
| 4,655,830 | 4/1987 | Akashi et al. | 75/233 |
| 4,676,829 | 6/1987 | Chang et al. | 75/246 |
| 4,746,363 | 5/1988 | DeAngelis | 75/244 |
| 4,762,557 | 8/1988 | Nagarajan et al. | 75/244 |
| 4,762,558 | 8/1988 | German et al. | 75/246 |

FOREIGN PATENT DOCUMENTS 584052 12/1987 U.S.S.R. .

OTHER PUBLICATIONS

Holt (I), "The Use of Exothermic Reactions in the Synthesis and Densification of Ceramic Materials," MRS Bulletin, 60–64 (Oct. 1/Nov. 15, 1987).

Holt et al., "Combustion Synthesis of Titanium Carbide: Theory and Experiment", *J. Mat. Sci.* 21: 251–259 (1986).

Borovinskaya et al., "Possibilities for Obtaining Composite Materials Under Combustion Conditions," *Combust. Processes in Chem. Tech. and Metallurgy,* 141–146 (Moscow 1975).

Maksimov et al., "High Temperature Synthesis of the System Ti–B–Fe," *Investiya. Akad. Nauk. SSSR, Metally,* 2: 219–223 (1985).

Riley et al., "Low Pressure Compaction of SHS Prepared Ceramics and Cermets," *Materials Processing by SHS* (eds. Gabriel et al.) (DARPH/ARMY Symp. Proc.) (Fla. Oct. 21–23, 1985).

Munir, "Synthesis of High Temperature Materials by Self-Propagating Combustion Methods," Am. Cer. Bull., 67 (2): 342–349 (Feb. 1988).

Holt (II), "Combustion Synthesis: A New Area of Research in Materials Science," LLNL Brochure (LLL-TB-84 May 1986).

Miyamoto et al., "High-Pressure Self-Combustion Sintering for Ceramics," Comm. Am. Ceram. Soc., C-22-4-225 (Nov. 1984).

(List continued on next page.)

*Primary Examiner*—Stephen J. Lechert, Jr.
*Assistant Examiner*—Leon Nigohosian
*Attorney, Agent, or Firm*—Leona L. Lauder; L. E. Carnahan; William R. Moser

[57] ABSTRACT

Dense, finely grained composite materials comprising one or more ceramic phase or phase and one or more metallic and/or intermetallic phase or phases are produced by combustion synthesis. Spherical ceramic grains are homogeneously dispersed within the matrix. Methods are provided, which include the step of applying mechanical pressure during or immediately after ignition, by which the microstructures in the resulting composites can be controllably selected.

16 Claims, 7 Drawing Sheets

OTHER PUBLICATIONS

Yamada et al. (I), "High-Pressure Self-Combustion Sintering of Silicon Carbide," *Am Ceram Soc. Bull.*, 64 (2): 319-321 (Feb. 1985).

Yamada et al. (II), "High-Pressure Self-Combustion Sintering of Titanium Carbide," *Comm. Am. Ceram. Soc.*, 70 (9): C-206-C-208 (1987).

Takano et al., "New Application of HIPing to Combustion Sintering of $TiB_2$," *Proc. 3rd. Internat'l Conf. on Isostatic Pressing*, vol. 1, pp. 21-111 (London Nov. 10-12, 1986).

Rice et al., "Hot Rolling of Ceramics Using Self-Propagating High-Temperature Synthesis," Ceram. Eng. and Sci. Proc., 7 (7-8): 651-760 (1968).

Richardson et al., "Hot Pressing of Ceramics Using Self-Propagating Synthesis," *Proc. 10th Ann. Conf. on Composites and Advanced Ceramic Mat.*, 7 (7-8), 760-770 (Fla. Jan. 19-24, 1986).

Stringer et al., "Reaction Pressing: A New Fabrication Concept for Intermetallic and Metal-Metalloid Compounds," *Proc. 4th Symp. on Spec. Ceramics* (Ed. Popper), 4: 37-55 (1967).

VARIATION OF POROSITY WITH BINDER COMPOSITION

VARIATION OF POROSITY WITH BINDER CONTENT

GRAIN SIZE VARIATION WITH BINDER CONTENT

VARIATION OF POROSITY WITH APPLIED PRESSURES

DENSE, FINELY, GRAINED COMPOSITE MATERIALS

The United States Government has rights in this invention pursuant to Contract No. W-7405-ENG-48 between the U.S. Department of Energy and the University of California for the operation of the Lawrence Livermore National Laboratory.

This is a Division of application Ser. No. 07/260,757 filed Oct. 21, 1988 pending 11/20/89.

FIELD OF THE INVENTION

This invention is in the general area concerning the production of composite ceramic products. More specifically, it relates to the production of dense, finely grained composite materials comprising ceramic and metallic phases in self-propagating high temperature synthesis (SHS) processes. Still more specifically, it relates to the production of said composite materials by a SHS process wherein mechanical pressure is applied during or immediately following the SHS reaction.

BACKGROUND OF THE INVENTION

The use of a combustion reaction to synthesize a refractory material was first considered by Walton et al. [*J. Am. Ceram. Soc.*, 42(1): 40–49 (1959)] who produced a composite ceramic/metallic material using thermite reactions. In the late 1960's, A. G. Merzhanov and his colleagues began work on self-propagating combustion reactions which led to the development of a process which they called "self-propagating high temperature synthesis" (SHS). [See Merzhanov et al., *Dokl. Chem.*, 204 (2): 429–32 (1972); Crider, *Ceram. Eng. Sci. Proc.*, 3 (9–10): 538–554 (1982).]

Self-propagating high temperature synthesis (SHS), alternatively and more simply termed combustion synthesis, is an efficient and economical process of producing refractory materials. [See for general background on combustion synthesis reactions: Holt, *MRS Bulletin*, pp. 60–64 (Oct. 1/Nov. 15, 1987): and Munir, *Am. Ceram. Bulletin*, 67 (2): 342–349 (Feb. 1988).] In combustion synthesis processes, materials having sufficiently high heats of formation are synthesized in a combustion wave which, after ignition, spontaneously propagates throughout the reactants converting them into products. The combustion reaction is initiated by either heating a small region of the starting materials to ignition temperature whereupon the combustion wave advances throughout the materials, or by bringing the entire compact of starting materials up to the ignition temperature whereupon combustion occurs simultaneously throughout the sample in a thermal explosion.

In the synthesis of refractory materials by conventional methods, the chemical reaction is initiated and carried to completion by heat from an external source such as a furnace. Usually, the heating rate is purposely kept low to avoid large temperature excursions caused by the high heats of reaction. Refractory materials prepared by such conventional methods are relatively expensive due to the high cost of energy and equipment. In the combustion synthesis process, however, after ignition has occurred, the rest of the sample is subsequently heated by the heat liberated by the reaction without the input of further energy. As a result, the power needed is much lower, and expensive equipment, such as high temperature furnaces, are not required.

Work on ceramic-metal composites has established that optimum physical properties are found in composites which have very small ceramic grains that are well dispersed within the metallic matrix materials. Conventional methods of synthesizing these composite materials leads to dense but typically large grained materials. Excessive grain growth occurring during conventional (non-SHS) synthesis leads to decreased strength of materials because of the association of large grain size with transgranular failure of the materials. Because of the very high heating and cooling rates and short reaction times of combustion synthesis, grain growth is slight, and therefore, unlike the products of conventional processes, the products of combustion synthesis are fine grained.

Advantages of combustion synthesis include: (1) higher purity of products; (2) low energy requirements; and (3) relative simplicity of the process. [Munir, supra at 342.] However, one of the major problems of combustion synthesis is that the products are "generally porous, with a sponge-like appearance." [Yamada et al., *Am. Ceram. Soc.*, 64 (2): 319–321 at 319 (Feb. 1985).] The porosity is caused by three basic factors: (1) the molar volume change inherent in the combustion synthesis reaction; (2) the porosity present in the unreacted sample; and (3) adsorbed gases which are present on the reactant powders.

Because of the porosity of the products of combustion synthesis, the majority of the materials produced are used in powder form. If dense materials are desired, the powders then must undergo some type of densification process, such as sintering or hot pressing. The ideal production process for producing dense SHS materials would combine the synthesis and densification steps into a one-step process. To achieve the goal of the simultaneous synthesis and densification of materials, three approaches have been used: (1) the simultaneous synthesis and sintering of the product; (2) the application of pressure during (or shortly after) the passage of the combustion front; and (3) the use of a liquid phase in the combustion process to promote the formation of dense bodies. [Munir, supra at 347.]

Various methods of applying pressure have been incorporated into experimental SHS processes. Rice et al. [*Ceram. Eng. and Sci. Proc.* 7 (7–8): 651–760 (1968)] used a rolling mill technique on the systems, $TiB_2$—$Al_2O_3$, TiC-Ti, and $TiB_2$-TiC. Miyamoto et al. [*Comm. Am. Ceram. Soc.*, C-224–225 (Nov. 1984)], Yamada et al. [*Am. Ceram. Soc. Bull.*, 64 (2): 319–321 (1985)], and Yamada et al. [*J. Am. Ceram. Soc.*, 70 (9): C-206–C-208 (1987)] used a high pressure (3 giga Pascals) cubic anvil apparatus in a process which they call "high-pressure self-combustion sintering (HPCS)" to densify a variety of ceramic materials. Both Holt, supra and Takano et al. [*Proc. 3rd Internatl. Conf. on Isostatic Pressing*, Vol. 1, pp. 21–1 to 21–11 (London Nov. 10–12, 1986)] applied hot isostatic pressing (HIP) technology to the combustion synthesis of ceramic materials. The simplest method of applying pressure to a combustion synthesis reaction is the use of a hot pressing apparatus. That technique has been used by Holt et al. [*J. Mat. Sci.*, 21: 251–259 (1986)]., Richardson et al. [*Proc. 10th Ann. Conf. on Composites and Advanced Ceramic Materials*, 7 (7–8): 760–770 (Fla. Jan. 19–24, 1986)], and Riley et al. [*DARPA/Army SHS Symposium Proc.*, MTL SP 87–9: 153–166 (Fla. Oct. 21–23, 1985; eds. Gabriel et al.) and Army Ballistic Research Laboratories, BRL-MR-35-74 (Mar. 1987)], [See also: Soviet Patent No. 584,052

(Merzhanov et al. 1977); U.S. Pat. No. 4,431,448 (Merzhanov et al. 1984); U.S. Pat. No. 3,353,954 (Williams et al. 1967); (Holt et al, *DARPA/Army SHS Symposium Proc.*, (Fla. Oct. 21–23, 1985) and UCRL-93467 (Jan. 1986); and Stringer et al., *Proc. 4th Symp. on Spec. Ceram.* (ed. Popper), 4: 37–55 (1967).]

Riley et al., supra, reports the combustion synthesis of ceramic/metallic composites (TiC and TiB2 with 10% Ni or Cu) wherein external pressures of up to 60 k psi were applied.

Borovinskaya et al. [*Combust. Processes in Chem Tech. and Metallurgy,* 141–146 (Moscow 1975)] investigated the interaction of Mo and Re with TiC formed during combustion synthesis in a high-pressure apparatus (200 atm). The product was 85% dense. The Mo and Re did not form an intermetallic compound but were alloyed in the process.

The present invention solves the problem of porosity of combustion synthesis products by applying relatively low pressure to the materials during or immediately following the combustion reaction. In doing so, the invention provides a low cost, commerically adaptable combustion synthesis process wherein synthesis and densification occur in essentially one step.

It is an object of this invention to produce materials by combustion synthesis that are less expensive than and have superior characteristics to those produced by conventional (non-SHS) processes. The fine grained and dense materials produced by the processes of this invention have enhanced fracture and impact strength as well as enhanced fracture toughness. For example, the invention provides alternative materials to those based on tungsten (W), which is very expensive due to its scarcity. The high hardness and melting point of titanium carbide (TiC) exceed those of tungsten carbide (WC); however, metallic composites of TiC produced by conventional processes have not gained commercial acceptance due mainly to their strength being lower than WC-Co. The comparatively low strength of such TiC composites can be attributed to excessive grain growth occurring during its formation in conventional processes. This invention solves that problem by providing a relatively inexpensive means to produce fine grained ceramic/intermetallic products that are also dense.

It is a further object of the invention to provide ceramic/intermetallic and ceramic/metallic composite materials wherein the ceramic grains are not only small in diameter but also spherical in shape and homogeneously dispersed within the intermetallic matrix. The materials produced according to the invention are improved by the sphericality of the ceramic grains in that the absence of angles removes potential stress points that could be sites of fracture or failure.

SUMMARY OF THE INVENTION

The present invention provides compositions of matter which are dense composite materials comprising one or more finely grained ceramic phases and one or more intermetallic phases wherein:

(a) the ceramic phase or phases is or are selected from the group consisting essentially of TiC, TiB, $TiB_2$, ZrC, $ZrB_2$, HfC, $HfB_2$, TaC, $TaB_2$, NbC, $NbB_2$, SiC and $B_4C$; and wherein (b) the intermetallic phase or phases is or are selected from the group comprising nickel aluminides, titanium aluminides, copper aluminides, titanium nickelides, titanium ferrides, and cobalt titanides.

The invention further concerns such compositions of matter, comprising a ceramic phase or phases and an intermetallic phase or phases as outlined above, which further comprise a metallic phase or phase wherein one metallic phase or phases is or are selected from the group consisting of Al, Cu, Ni, Fe and Co. Preferably, the metallic phase or phases is or are Al and/or Ni, and more preferably Al.

The invention further concerns processes for producing said composite materials by combustion synthesis wherein mechanical pressure is applied during or immediately following ignition of the reactants. The processes for producing said dense composite materials comprise the steps of:

(1) selecting at least one element from each of the following groups:
  (a) a group consisting of Ti, Zr, Hf, Ta, Nb, Si and B;
  (b) a group consisting of C and B;
  (c) a group consisting of Ni, Ti and Cu; and
  (d) a group consisting of Al, Ti, Fe and Co;
  with the provisios that if the element selected in group (a) is Si or B that the element of group (b) that is selected is C; that if the element selected from group (c) is Ti then the element selected from group (d) is not Ti; that if nickel is selected in group (c), that either Al or Ti are selected in group (d); and that if Cu is selected from group (c), that Al is selected from group (d);
(2) mixing the elements selected in step (1);
(3) igniting said selected elements; and
(4) applying mechanical pressure during or immediately after the ignition of step (3).

The invention further provides a process for producing a dense composite material, wherein said material comprises one or more finely grained ceramic phase or phases and one or more metallic phase or phases, by combustion synthesis comprising the steps of:

(1) selecting at least one element from each of the following groups:
  (a) a group consisting of Ti, Zr, Hf, Ta, and Nb;
  (b) a group consisting of C and B;
  (c) a group consisting of Ni, Fe, Co, Al and Cu;
(2) mixing the elements selected in step (1);
(3) igniting said selected elements; and
(4) applying pressure in a range of from about 5 MPa to about 60 MPa during or immediately after the ignition of step (3). Preferably, in said process, the metallic element of group (c) is Ni or Fe, and more preferably Ni. Preferably the element selected in group (a) of that process is Ti.

The invention further concerns the products produced by said processes.

BRIEF DESCRIPTION OF THE DRAWINGS

FIG. 1B is a magnification of the zone of rapid temperature rise found in FIG. 1A.

DETAILED DESCRIPTION OF THE INVENTION

Figure 1A:
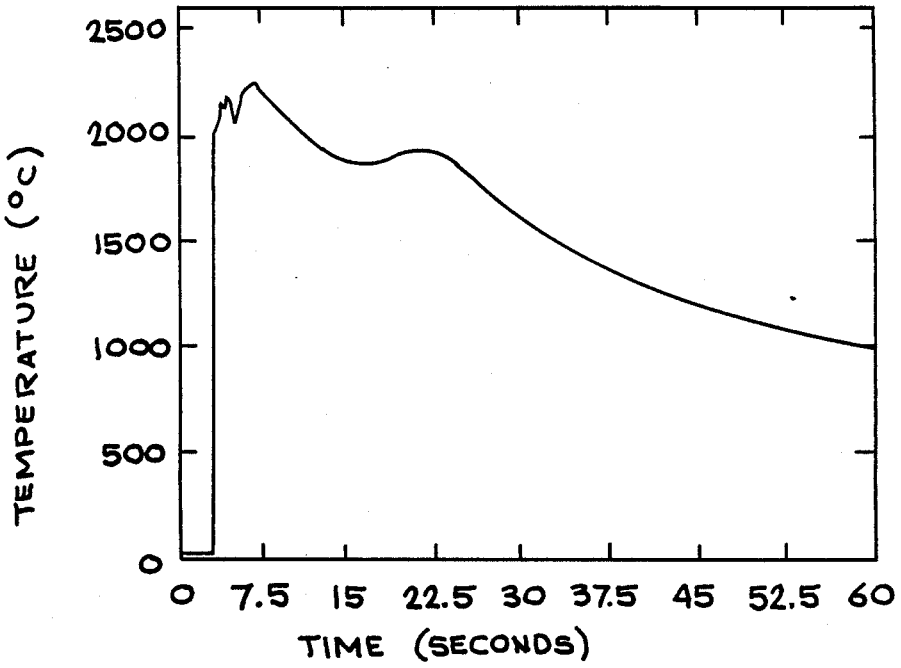
FIGS. 1A and 1B show the temperature profile measured during the combustion synthesis of the mixture Ti+C+50% by weight (Ni+Al).

The phrase "finely grained" is herein used to denote ceramic grains within a metallic and/or intermetallic matrix which are less than 10 microns in diameter, preferably less than 5 microns in diameter, more preferably less than 2 microns in diameter and still more preferably less than 1 micron in diameter.

As used herein, the terms "binder" or "matrix" denote the components of the metallic and/or intermetallic phases of the composite materials produced according to this invention.

The term "intermetallic" is herein defined to be a compound composed of two or more metals.

The term "immediately" is herein defined to mean within a period of two minutes, preferably within 25 seconds, and more preferably within 5 seconds.

The term "dense" is used herein to denote a property of a material having a density which is greater than 85% of theoretical, preferably greater than 90%, more preferably greater than 95%, still more preferably greater than 97%, and even still more preferably greater than 99% of theoretical, wherein density is mass per unit volume. "Preferably" is herein used relatively depending on the application for which the composite materials are being produced.

The term "dopant" is herein used to denote a substance added in small quantities (that is, approximately less than 2% by weight of the product) to the reagents in the processes of this invention to alter the properties of the product and/or the parameters of the process.

The term "diluent" is used herein to denote a substance that is added to the reagents in the processes of this invention to drop the combustion temperature of the reaction; said substance does not therefore produce heat during the combustion reaction, that is, it is effectively inert in the processes of this invention.

The phrase "well dispersed" is herein used to indicate the homogeneous distribution of ceramic grains within the bulk of the matrix of the composite materials of this invention. It is preferred that the ceramic grains of the composite materials of this invention be not only finely grained but also spherical and well dispersed.

The composite materials of this invention are preferably comprised of ceramic and intermetallic and/or metallic phases wherein the ratio by weight of the ceramic phase to the intermetallic and/or metallic phase is in the range of from about 1:10 to about 100:1, more preferably from about 1:8 to about 15:1, and still more preferably from about 1:3 to about 7:1. It is preferred wherein the composite material produced according to this invention comprises a finely grained ceramic phase and a metallic phase that the metallic phase is at least 10% by weight of the product, more preferably greater than 15% by weight of the product, and still more preferably greater than 20% by weight of the product.

Although the invention is primarily described herein with respect to composite materials comprising titanium carbide (TiC) as the ceramic phase, and the Ni-Al system as the intermetallic phase or Ni or Al as the metallic phase, the invention also applies to and includes other ceramic, intermetallic and/or metallic phases. As indicated above under the Summary of the Invention, ceramic phases other than TiC include TiB, $TiB_2$, ZrC, $ZrB_2$, HfC, $HfB_2$, TaC, $TaB_2$, NbC, $NbB_2$, SiC and B4C. Preferably, the ceramic phase is either TiC, TiB or $TiB_2$. More preferably, the ceramic phase is either TiC or $TiB_2$, and still more preferably TiC.

The intermetallic phase is preferably selected from the group comprising nickel aluminides, titanium aluminides, copper aluminides, titanium nickelides, titanium ferrides, and cobalt titanides. More preferably, the intermetallic phase is selected from the group of nickel aluminides or titanium aluminides. Still more preferably, the nickel aluminides are selected from the group consisting of NiAl, $Ni_3Al$, $Ni5Al_3$, $Ni_2Al_3$ and $NiAl_3$; and the titanium aluminide is $TiAl_3$. Preferable intermetallic and/or metallic phase combinations include $Ni_2Al_3$ and $NiAl_3$; NiAl and $Ni_3Al$; $TiAl_3$ and Al; and $Ni_2Al_3$, $NiAl_3$ and $TiAl_3$.

More preferably, the compositions of this invention comprise a dense composite material which comprises a finely grained ceramic phase and one or more intermetallic phases wherein the ceramic phase is either TiC, TiB or $TiB_2$ and the intermetallic phase or phases is or are NiAl, $Ni_3Al$, $Ni_2Al_3$, $NiAl_3$ and/or is $TiAl_3$; more preferably the intermetallic phase or phases is or are NiAl and/or $Ni_3Al$; and still more preferably the intermetallic phase is NiAl. Still more preferably, the ceramic phase is TiC or $TiB_2$ and the intermetallic phase is either NiAl or $Ni_3Al$, more preferably NiAl.

The composite materials of this invention are prepared by combustion synthesis processes wherein mechanical pressure is applied during or immediately following ignition. As indicated above under the definition of "immediately", it is preferred that the pressure be applied within at least two minutes of ignition, more preferably within 25 seconds of ignition, and still more preferably within 5 seconds of ignition. It is important that the pressure be applied when at least a portion of the components are in a liquid phase. It is a commercially advantageous aspect of the instant invention that the components selected for the composite materials of the invention remain in a liquid state for a suitable time period so that pressure can be applied within the constraints of commercial production parameters.

The mechanical pressure is applied during or immediately following ignition for a time period of from about 10 seconds to about 5 minutes, and generally for about 1 minute to two minutes until the reaction has cooled sufficiently.

Another commercially advantageous aspect of this invention is that the pressures required to produce the dense, finely grained composite materials of this invention are relatively low. It is preferred that the pressure applied be within the range of from about 5 MPa (mega Pascals) to about 60 MPa, more preferably from about 10 MPa to about 30 MPa, and still more preferably from about 20 MPa to about 30 MPa. (See FIG. 10 for a representative relationship between porosity and applied pressure.)

Where the process of this invention concerns the production of a dense composite material comprising a finely grained ceramic phase and a metallic phase, it is preferred that the pressure be applied in the ranges stated above and again during or immediately after ignition. It is preferred that the elements ignited in said process be selected from each of the following groups: (a) a group consisting of Ti, Zr, Hf, Ta, and Nb; a group consisting of C and B; and (c) a group consisting of Ni, Fe, Co, Al and Cu. It is further preferred that one element be selected from each group and that group (c) consists of Ni and Fe. It is further preferred that the group (a) element be Ti; and it is still further preferred that that group (c) element be Ni.

The pressure can be applied in a variety of ways including methods employing moulds, gasostats and hydrostats among other devices known in the art. Methods include hot pressing, either uniaxial or isostatic (including hot isostatic pressing), explosive compaction, high pressure shock waves generated by example from gas guns, rolling mills, vacuum pressing and other suitable pressure applying techniques.

The source of ignition for the combustion synthesis processes of this invention is not critical. Any source providing sufficient energy for ignition would be suitable. Exemplary methods include sources such as laser beams, resistance heating coils, focused high intensity radiation lamps, electric arcs or matches, solar energy, thermite pellets among other sources.

The nature and composition of the product phases can be controlled by varying the ratios of the starting reagents, the level of mechanical pressure, by adding diluents and/or dopants, and by other methods apparent to those of ordinary skill in the art from the instant disclosure. By varying the combustion synthesis parameters, the properties of the product can be tailored to meet specific application needs.

Exemplified herein are other methods by which by altering the parameters of the processes of the invention that the properties of the products can be consequently altered. For example, shown below is how the amount of binder in the product can alter the product's porosity, and also how the level of mechanical pressure can affect the product's porosity.

In general, increasing the temperature of combustion has the effect of increasing the density of the product and of increasing the grain size of the product composite; whereas decreasing the reaction time has the effect of decreasing the grain size. The effect of most diluents in the systems herein outlined would be to both decrease the temperature of combustion and increase the reaction time. The temperature effect, however, is dominant because grain growth is exponentially dependent on temperature, and thus, the grain size of the product composite decreases.

Further, in the systems herein outlined, increasing the amount of binder would decrease the combustion temperature and consequently the grain size. Increasing the amount of binder as shown below results in an increase in the density of the product. Also, in general increasing the pressure applied increases the density of the product.

Applications of the composite materials produced according to this invention include their use as cutting tools, wear parts, structural components, armor, among other uses. Some uses to which the materials produced according to this invention can applied may not demand as high a density as others. For example, materials used for filters, industrial foams, insulation, and crucibles, may not be required to be as dense as materials used for armor or abrasive and wear resistant materials. Therefore, the use to which the product composite material is to applied can be determinative of the conditions of synthesis that would be optimal from an efficiency and economy standpoint. For example, if the material need only be 90% dense rather than 95% dense, less pressure could be applied resulting in energy savings.

Other potential applications for the composite materials of this invention include abrasives, polishing powders, elements for resistance heating furnaces, shape-memory alloys, high temperature structural alloys, steel melting additives and electrodes for the electrolysis of corrosive media.

It is preferred that the diluents to be mixed with the elements to be combusted according to this invention be pre-reacted components of the product ceramic and/or intermetallic phases; that is, for example, if the desired product is a composite material comprising TiC ceramic grains in a NiAl matrix, that the diluent be either TiC and/or NiAl. Preferred diluents include TiC, TiB, $TiB_2$, $Ni_3Al$ and/or NiAl.

It is further preferred that wherein the diluent selected is a ceramic, that the percentage range by weight of said ceramic diluent be from about 0% to about 20% of the total weight of the ceramic phase formed in the combustion synthesis reaction. It is also further preferred that wherein the diluent selected is an intermetallic, that the percentage range by weight of said intermetallic diluent be from about 0% to about 50% of the total weight of the intermetallic phase formed in the combustion synthesis reaction.

A preferred dopant for addition in the processes of the invention is boron. A small quantity of boron can result in more rapid densification and enchanced properties of the product composite.

Representative are results achieved in the TiC and Ni-Al system. For these studies and examples described below, small particle sizes of titanium, nickel, aluminum, and carbon were used. The titanium, obtained from Alfa Products, had an average particle size of 11 microns. A spectrochemical analysis showed the principal impurities therein to be: Zr, 5000 ppm; Al, 2000 ppm; Ca, 1000 ppm; Si, 100 ppm; Mn, 100 ppm; and Mg, 100 ppm. The nickel powder, obtained from Em Scientific, had an average particle size of 83 microns. The major impurities were found therein to be: Co, 100 ppm; Cu, 2 ppm; and Al, 1 ppm. The aluminum powder, obtained from ALCOA, had an average particle size of 9.9 microns. The major impurities were found therein to be: Fe, 100 ppm; Si, 30 ppm; Ga, 10 ppm; Cu, 10 ppm; and Mn, 10 ppm. Monarch 905 furnace black, a very fine (0.01 micron) powder obtained from Cabot Corporation was used as a carbon source. Table I contains a summary of the surface area and average particle size data for the reagents used.

TABLE I

Characterization of Reagent Powders

| Regent | Mean Particle Size (micron) | Surface Area ($m^2/g$) |
|---|---|---|
| Ti(Alfa) | 11.0 | 0.48 |
| Ni(EM Scientific) | 83.0 | 0.06 |
| Al(ALCOA) | 9.9 | 1.10 |
| C(Cabot) | 0.01 | 230 |

Reagent powder mixtures were prepared for the following three basic reactions:

$$Ti+C+x(Ni+Al) \quad (1)$$

$$Ti+C+x(3Ni+Al) \quad (2)$$

$$50wt\%(Ti+C)+50wt\%(yNi+zAl) \quad (3)$$

wherein x ranged from 12.5% to 75% by weight and wherein y and z were such that the proper stoichiometry existed in the mixture to form each of the Ni-Al compounds known to exist.

The reagent powders were weighed out in the proper stoichiometric proportions such that a constant equimolar ratio of Ti to C was maintained but wherein the amounts of Ni and Al and the ratio of Ni to Al were varied. The powder batches were mixed in a glass jar for 30 minutes on a mechanical shaker and were inspected periodically to insure that even mixing was occurring.

The powder mixture was then poured into a cylindrical graphite die that had been fitted with a 254 micron (10 mil) graphoil liner. The liner served both to protect the die and to promote the escape of gases during combustion. The graphite die was equipped with double acting graphite rams which were machined such that there was a clearance of 83 microns (5 mil) after insertion of the graphoil liner.

Figure 2:
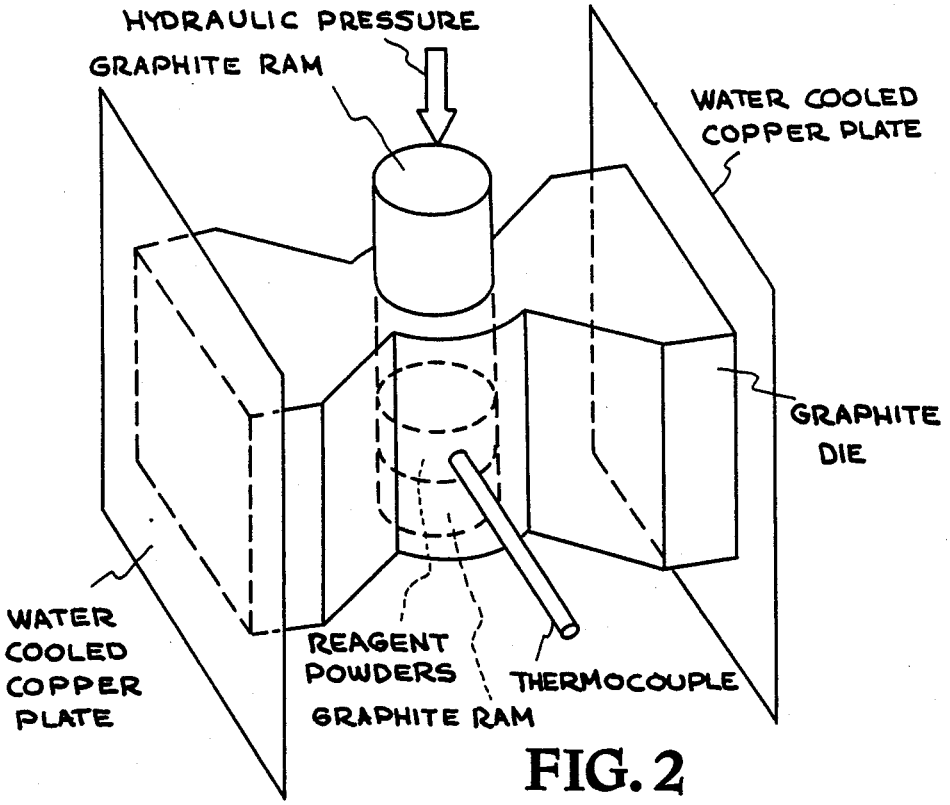
FIG. 2 schematically illustrates the hot pressing apparatus used in the examples described herein.

The powder mixture was cold pressed at a pressure of 20.7 MPa (3000 psi) where it achieved a density of approximately 50% of theoretical. The die assembly was then inserted into the hot pressing apparatus as shown schematically in FIG. 2. The graphite die was heated at approximately 1500° K/min by placing a potential across the copper plates and allowing the current flow to resistively heat the die. A thermocouple was inserted into a hole in the side of the die so that the approximate die temperature at ignition could be monitored. When ignition occurred (in the 923°-973° K temperature range) the hydraulic rams were compressed to the desired pressure. The pressure was held for approximately 1 to 2 minutes (until the die was not red hot).

After removal of the specimen, it was sectioned and prepared for analysis. X-ray diffraction showed the specimen's phase composition. Metallographic examination indicated how finely grained the material was. Mercury porosimetry indicated the level of porosity.

Temperature Profiles

Figure 1B:
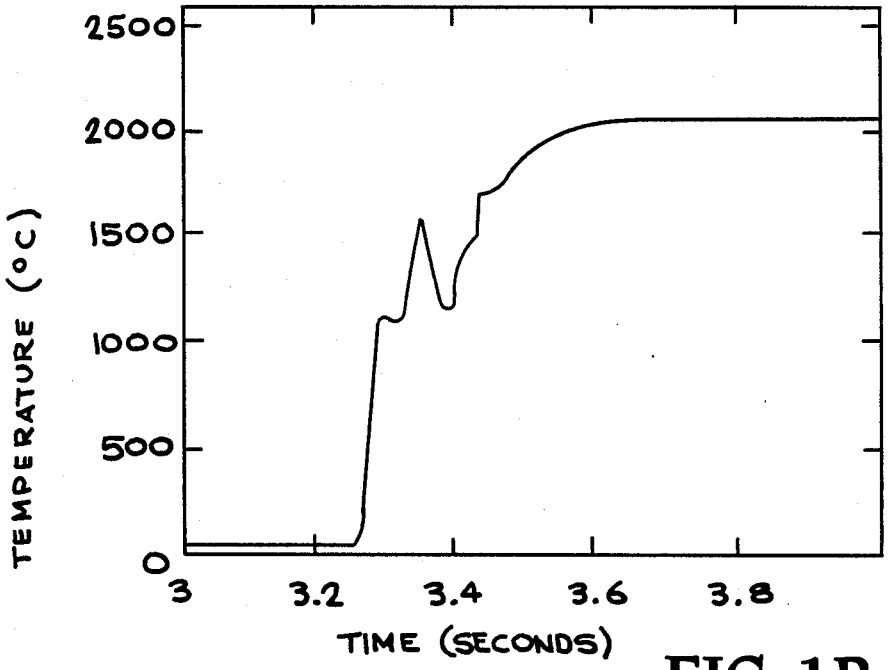

FIG. 1A shows a temperature profile measured during the combustion of the mixture shown in equation 1 (above) wherein x has a value of 50 wt %. In this experiment an 80 micron (3 mil) tungsten-rhenium thermocouple was placed into a small hole in the bottom of the sample opposite the end where ignition occurred. The output voltage of the thermocouple was monitored. FIG. 1A shows that the reaction between solids is typified by a relatively sharp rise from ambient temperature up to a peak combustion temperature of approximately 2200 degrees C. followed by cooling to a plateau at approximately 1800 degrees C., a slight increase in temperature and then further cooling back to ambient temperature. The heating rate realized in the zone of sharpest temperature increase was calculated to be on the order of $5\times10^4$ K/s. The temperature profile shown in FIG. 1B is a magnification of the zone of rapid temperature rise found in FIG. 1A.

The temperature profile in FIG. 1A indicates that the compact remains at an elevated temperature well after the combustion front has passed. The compact remains above 1638 degrees C., the melting point of NiAl (the phase in the Ni-Al system with the highest melting point), for approximately 23 seconds; a liquid phase must then exist for at least that period of time. It is, therefore, within such period that pressure is applied for densification.

Binder Composition

X-ray Diffraction

Table II shows the results of x-ray diffraction work which was done on the products of combustion of the mixtures shown in equation 3 (above). All of these reactions were carried out in the hot pressing apparatus under a mechanical pressure of 20.7 MPa (3000 psi). In this series of experiments, the Ni to Al ratio in the binder was varied so that the stoichiometric relationships of all 7 compounds of the Ni-Al system (Ni, $Ni_3Al$, $Ni_5Al_3$, NiAl, $Ni_2Al_3$, $NiAl_3$ and Al) were represented. As can be seen in Table II, when the binder composition was Ni, 3Ni+Al, Ni+Al, and 2Ni+3Al, the product contained only TiC and the Ni-Al phase with the same stoichiometry as was in the reactants. When however, the binder composition was 5Ni+3Al, the product consisted of TiC, NiAl, and Ni3Al. It is also apparent from Table II that the compositions with high Al content (Ni+3Al and Al) result in complex phase relationships including the formation of $TiAl_3$.

TABLE II

X-Ray Diffraction Results for Reactions of the form 50 wt % (Ti + C) + 50 wt % (× Ni + yAl)

| Binder | TiC | Ni | $Ni_3Al$ | $Ni_5Al_3$ | NiAl | $Ni_2Al_3$ | $NiAl_3$ | Al | $TiAl_3$ |
|---|---|---|---|---|---|---|---|---|---|
| Ni | M | M | — | — | — | — | — | — | — |
| 3Ni + Al | M | — | S | — | — | — | — | — | — |

TABLE II-continued

| Binder | X-Ray Diffraction Results for Reactions of the form 50 wt % (Ti + C) + 50 wt % (× Ni + yAl) | | | | | | | | |
|---|---|---|---|---|---|---|---|---|---|
| | TiC | Ni | $Ni_3Al$ | $Ni_5Al_3$ | NiAl | $Ni_2Al_3$ | $NiAl_3$ | Al | $TiAl_3$ |
| 5Ni + 3Al | M | — | S | — | S | — | — | — | — |
| Ni + Al | M | — | — | — | S | — | — | — | — |
| 2Ni + 3Al | S | — | — | — | — | M | — | — | — |
| Ni + 3Al | S | — | — | — | — | M | m | — | m |
| Al | m | — | — | — | — | — | — | m | M |

M - Major Phase
S - Secondary Phase
m - Minor Phase
t - Trace Phase

Residual Porosity

Figure 3:
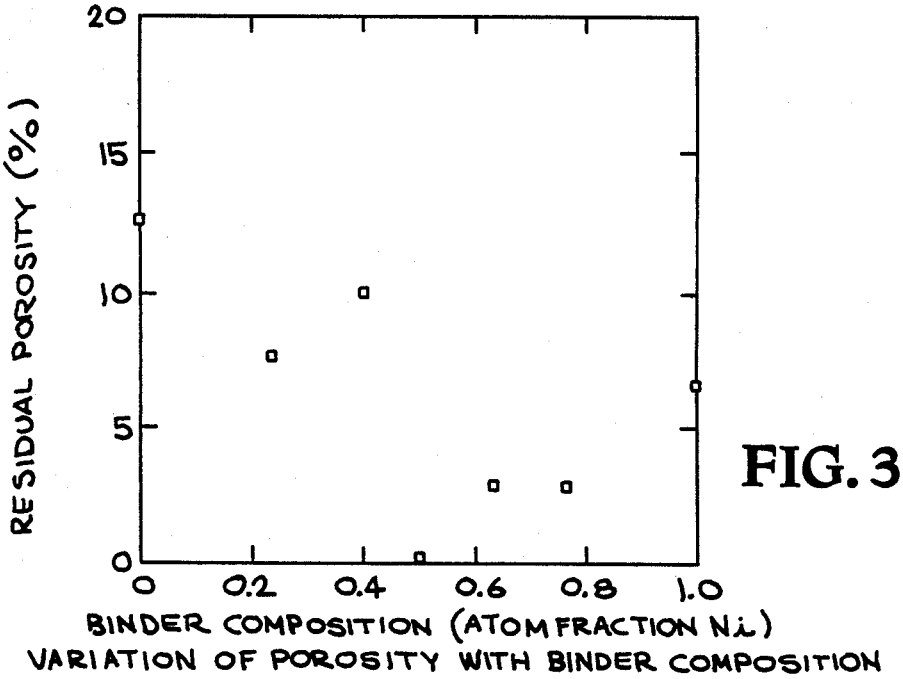
FIG. 3 illustrates the effect of varying the proportions of nickel and aluminum in the binder composition on the porosity of the product.
Figure 4:
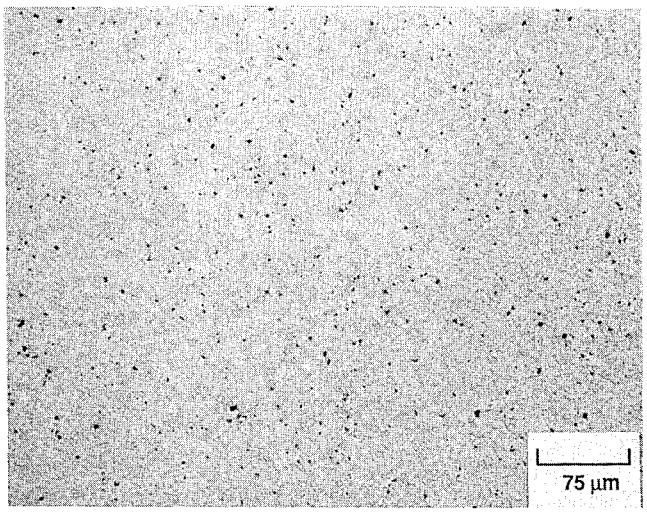
FIG. 4 is a photomicrograph (200×) of the composite product formed from the combustion synthesis of 75% by weight (Ti+C) and 25% by weight Ni according to the methods of this invention. The figure illustrates both the low porosity (3.9%) of the product and homogeneity of the porosity, that is, that the pores are very small and uniformly distributed.

The effect of the binder composition on the residual porosity was studied, and the results are show in FIG. 3. It can be seen therein that the sample which contained Ni+Al as the binder contains the least amount of porosity (0.3%) in the product. Because NiAl has the highest heat of formation of any of the Ni-Al compounds, this particular reaction would also be expected to have the highest combustion temperature. As a result, the liquid phase would be present for a longer period of time during the reaction, and therefore, it is more likely for more densification to occur. As an example of the homogeneity of the porosity found in the products of this invention, FIG. 4 shows a low magnification photomicrograph of a sample which contained 75 wt % (Ti+C) and 25 wt % (Ni). That sample was found to have a porosity of 3.9% and as can be seen, the pores are very small and well distributed.

Binder Content

Residual Porosity

Figure 5:
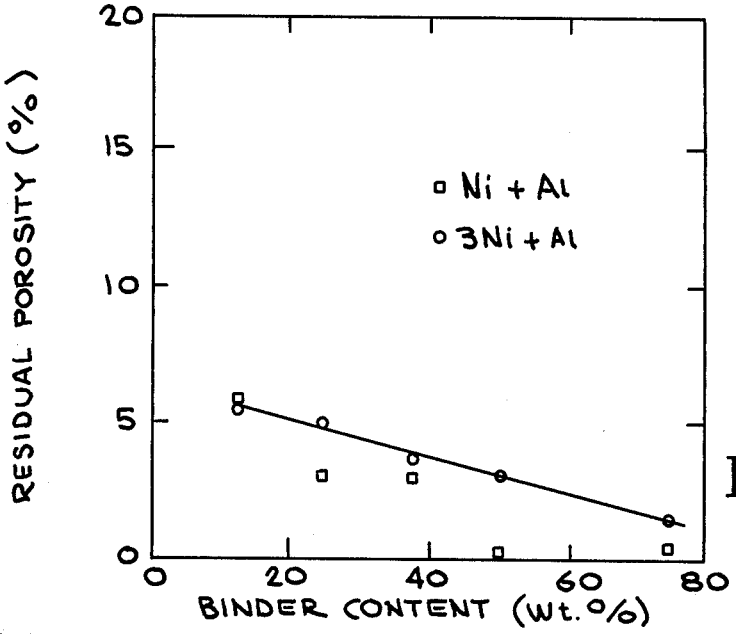
FIG. 5 graphically illustrates the effect of the amount of binder in the compact on the residual porosity of the final product for two sets of samples in which the product is either a TiC—NiAl or TiC—$Ni_3Al$ composite.

The effect of the amount of binder in the compact on the residual porosity of the final product was studied for two sets of samples in which the product was either a TiC—NiAl or TiC—$Ni_3Al$ composite. FIG. 5 shows the results for a set of experiments wherein a mechanical pressure of 20.7 MPa (3000 psi) was applied. FIG. 5 shows that there is in general a slight decrease in the level of porosity as the amount of binder in the compact increases. It can also be seen that at low binder contents, the identity of the binder has little effect on the residual porosity in the product. At higher binder contents, however, the compacts which contain NiAl as the binder have consistently lower levels of porosity than those which contain $Ni_3Al$. That difference in porosity is due to differences in the heat of formation of NiAl (-71650 J/K mole) and $Ni_3Al$ (-37550 J/K mole) as higher combustion temperatures favor densification.

Microstructure

Figure 6A:
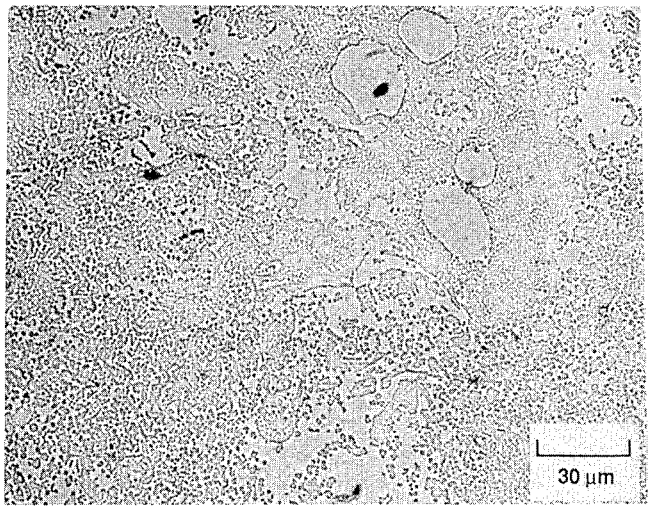
FIGS. 6A and 6B are photomicrographs (500× and 1000×, respectively) of the product of combustion synthesis according to this invention of 50% (wt) (Ti+C) and 50% (wt) (Ni+Al). The residual porosity was 0.3%. The spherical TiC grains in this sample average 1.1 microns in diameter.
Figure 6B:
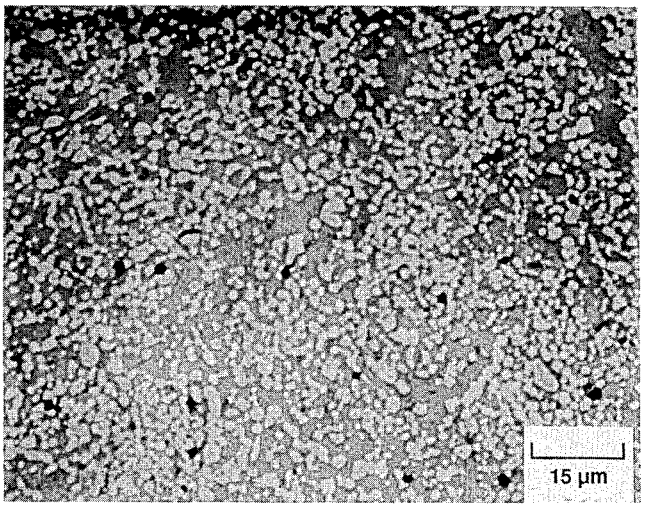

FIGS. 6A and 6B are optical photomicrographs of the product of combustion of 50 wt % (Ti+C) and 50 wt % (Ni+Al) at 500× and 1000×, respectively. A mechanical pressure of 20.7 MPa (3000 psi) was applied immediately following the combustion of the components of this sample. The resulting porosity was 0.3%. The spherical TiC grains (55 vol %) in this sample were found to average 1.1 microns in diameter, and the microhardness was measured to be 930 kg/mm2.

Figure 7A:
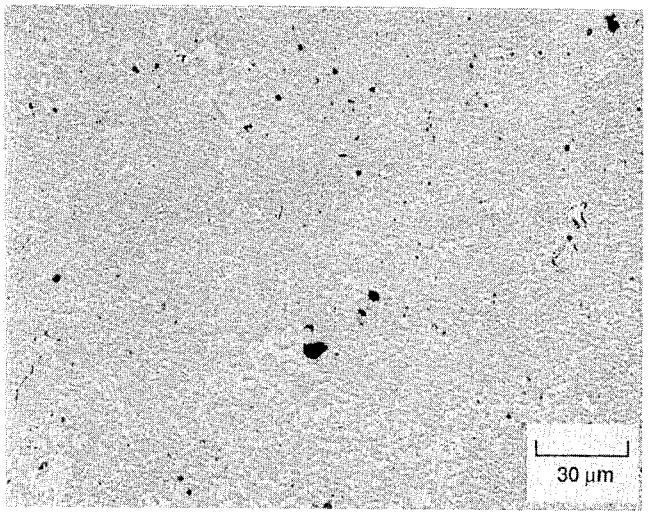
FIGS. 7A and 7B are photomicrographs (500× and 1000×, respectively) of the product of combustion synthesis according to this invention of 50% (wt) (Ti+C) and 50% (wt) (3Ni+Al). The residual porosity of the sample was 3.0%, and the average grain size was 1.2 microns.
Figure 7B:
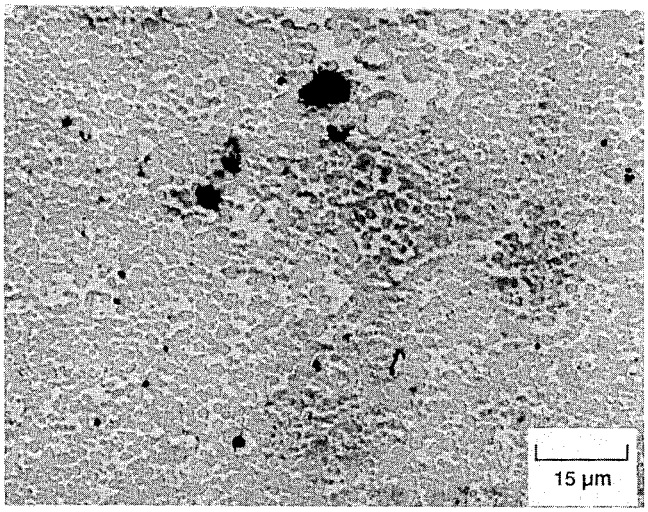

FIGS. 7A and 7B are optical photomicrographs of the product of combustion of 50 wt % (Ti+C) and 50 wt % (3Ni+Al) at 500× and 1000×, respectively. The same conditions of combustion were employed to produce this sample as for those of FIGS. 6A and 6B. This product was found to have a residual porosity of 3.0%, an average grain size of 1.2 microns, and microhardness of 1111 kg/mm2.

Figure 8:
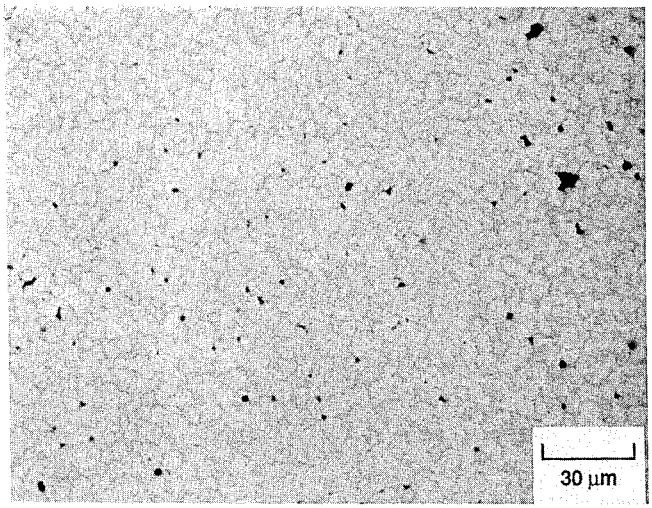
FIG. 8 is an photomicrograph (500×) of the product of combustion synthesis according to this invention of 75% (wt) (Ti+C) and 25% (wt) (Ni+Al). The residual porosity of the product was 5.7%, and the average grain size was 3.2 microns.

FIG. 8 is an optical photomicrograph of the product of combustion of 75 wt % (Ti+C) and 25 wt % (Ni+Al). The conditions of combustion were again the same as those for the product of FIGS. 6A and 6B. The residual porosity for this sample was 5.7%; the average grain size of the TiC was 3.2 microns in diameter; and the microhardness was measured to be 1916 kg/mm2.

To study the mechanism of formation of these composites, a sample identical to that shown in FIGS. 6A and 6B except that graphite fibers were used as the carbon source rather than carbon black was combusted. Although the reagent mixture with the graphite fibers was more difficult to mix and was harder to ignite than that with the carbon black, there was no evidence in the product that the fibers had ever existed. The grain size, porosity, and microhardness were virtually identical in the two samples with different forms of carbon reagents. These results indicate that during the reaction the carbon is dissolved into a melt, and that then the TiC precipitates out of the melt.

Figure 9:
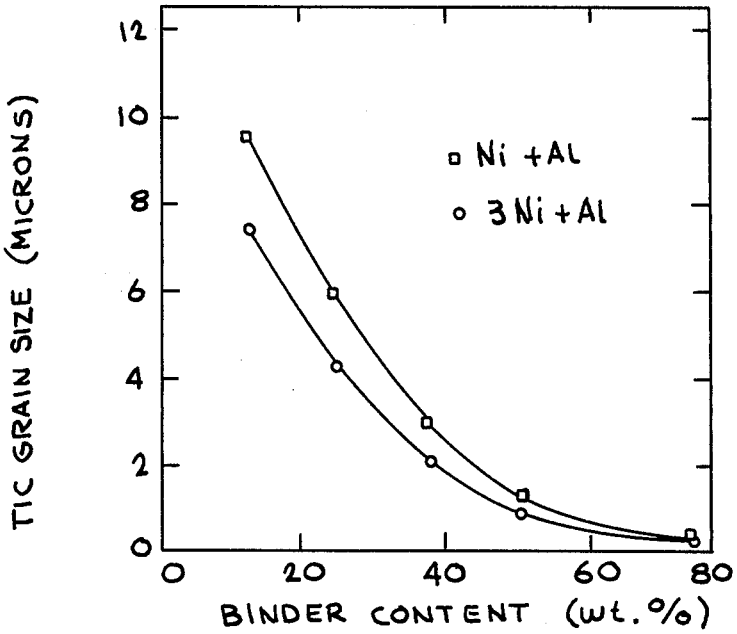
FIG. 9 shows the effect of the amount of binder (both NiAl and $Ni_3Al$) on the average ceramic grain size in the products of this invention that had been synthesized in a combustion process wherein a mechanical pressure of 20.7 MPa had been applied immediately after ignition. In general, grain size is shown to decrease with an increase in the amount of binder.

FIG. 9 shows the effect of the amount of binder (both NiAl and $Ni_3Al$) on the average grain size of TiC in the product. All of these specimens had a mechanical pressure of 20.7 MPa applied immediately after ignition. In general, the grain size decreases with an increase in the amount of binder. Since grain growth is exponentially dependent upon temperature, and since combustion temperature decreases with an increase in the amount of binder, smaller TiC grains occur with an increase in binder. FIG. 9 also shows that for samples which contain a similar amount of two different binders, those samples with the $Ni_3Al$ binder have consistently smaller TiC grains. This difference can again be attributed to the lowered combustion temperatures in those samples due to the lower heat of formation of $Ni_3Al$ compared to NiAl.

Applied Pressure

Figure 10:
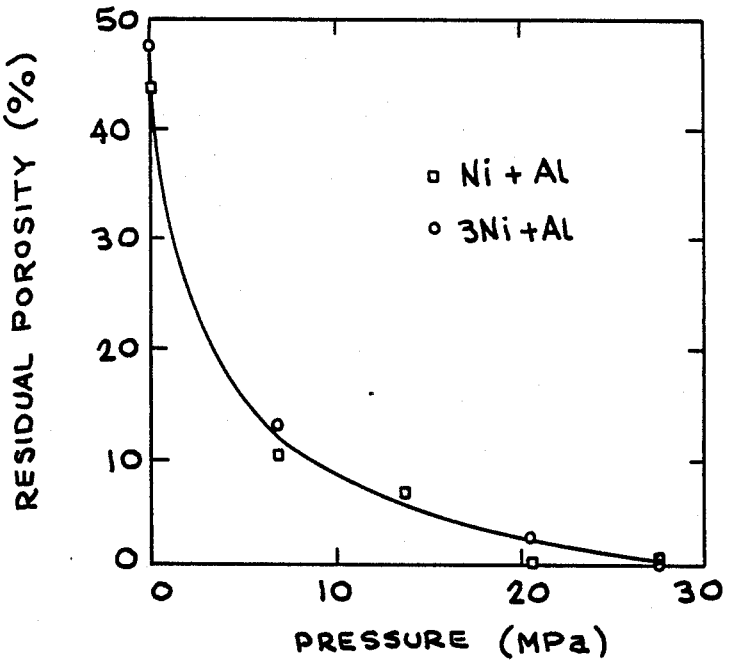
FIG. 10 illustrates the effect of pressure on the level of porosity in representative products of the invention which contain 50% (wt) of either NiAl or $Ni_3Al$ as the binder. This figure shows that application of pressures as low as 6.9 MPa (mega Pascals) (1000 psi) has marked effects on the residual levels of porosity and that an increase in the amount of applied pressure results in a decrease in the residual porosity.

FIG. 10 shows the effect of the amount of applied pressure on the level of porosity in the product for samples which contain 50 wt % of either NiAl or $Ni_3Al$ as the binder. It can be seen from this figure that the application of pressures as low as 6.9 MPa (1000 psi) has a significant effect on the level of porosity. The graph also shows that an increase in the amount of applied pressure results in a decrease in the residual porosity for both binders.

Thus, it can be seen by the experiments outlined herein that by changing the synthesis conditions, the grain size and the identity and distribution of phases can be altered, and as a result, so can the product properties. The composite materials combine the desirable properties of metals (toughness, high electrical and heat conductivities) with those of ceramics (high hardness, high melting points and good corrosion resistance). By altering the ratios of the ceramic to the intermetallic and/or metallic phases, the properties of the composite material products can be tailored to specific applications. For example, by increasing the proportion of ceramic, the hardness of the resulting composite would be increased. The composite materials of this invention have the potential for having high thermodynamic stability, high heat capacity, excellent microhardness and thermal expansivity.

Thus, it can be seen that dense, finely grained composite materials, which cannot be produced by conventional methods, are produced by the processes of this invention. Such fine grained, dense materials have enhanced fracture and impact strength and enhanced fracture toughness.

The following examples further illustrate the invention. The examples are not intended to limit the invention in any matter.

EXAMPLE 1

A mixture of the following composition in parts by weight (pbw) was prepared: Ti, 39.98; C, 10.02; Ni, 34.25; Al, 15.75. The metallic titanium powder used had a mean particle size of 11 microns and a specific surface area of 0.48 $m^2/g$; the carbon powder was amorphous furnace black with a mean particle size of 0.01 microns and a specific surface area of 230 $m^2/g$; the nickel powder had a mean particle size of 83 microns and a specific surface area of 0.06 $m^2/g$; and the aluminum powder had a mean particle size of 9.9 microns and a specific surface area of 1.1 $m^2/g$.

Approximately 20 g of the mixture was loaded into a cylindrical graphite die that was lined with graphoil. The graphite die was fitted with double acting graphite rams. The mixture was cold pressed uniaxially to a pressure of 20.7 MPa (3000 psi).

The compressed powder and die were then inserted into a hot pressing apparatus in which the die could be heated and pressure applied to the graphite rams. An electrical potential of approximately 5 volts was then placed across the die. The resulting current flow caused the die to rapidly heat up (approximately 1500° K/minute). When the temperature of the die reached the range of 933° to 1173° K a spark was given off and a thermal explosion took place. When this occurred the hydraulic rams were compressed to 20.7 MPa (3000 psi), and the electrical potential was turned off. This pressure was held until no visible radiation was emitted from the die (approximately 1 minute).

The resulting product (in pbw) consisted of: TiC, 50; NiAl, 50, with no other phases present in measurable amounts. The density as measured by mercury porosimetry was 5.361 $g/cm^3$ or 99.7% of what was theoretically expected. Examination by optical metallography showed the material to consist of very fine (1–2 microns, mean 1.2 microns) TiC grains in a NiAl matrix. Vickers microhardness measurements showed the hardness of the product to be approximately 930 $kg/mm^2$.

EXAMPLE 2

A mixture of the following composition (in pbw) was prepared with the same reagent powders as in Example 1: Ti, 39.98; C, 10.02; Ni, 43.36; Al, 6.64. The procedure followed was identical to that in Example 1.

The resulting product consisted of (parts by weight): TiC, 50; $Ni_3Al$, 50, with no other phases present in measurable amounts. The density was measured to be 5.674 $g/cm^3$ or 97% of theoretical. The material was found to be a very fine grained (mean 1.0 micron) TiC phase in a $Ni_3Al$ matrix. The Vickers microhardness was measured to be 1111 $kg/mm^2$.

EXAMPLE 3

A mixture of the following composition (in pbw) was prepared with the same reagent powders as in the previous examples: Ti, 59.97; C, 15.03; Ni, 17.12; Al, 7.88. The procedure followed was identical to the previous examples.

The resulting product consisted of: TiC, 75; NiAl, 25, with no other phases present in detectable amounts. The density was measured to be 4.85 $g/cm^3$ or 94.3% of theoretical. The material was found to consist of fairly fine (mean 5.9 microns) TiC grains in a NiAl matrix. The Vickers microhardness was measured to be 1916 $kg/mm^2$.

EXAMPLE 4

A mixture of the following composition (in pbw) was prepared with the same reagents as in the examples above: Ti, 39.98; C, 10.02; Ni, 34.25; Al, 15.75. The procedure followed was the same as in the previous examples with the exception that the hydraulic rams were compressed to 6.9 MPa (1000 psi) immediately after ignition.

The resulting product in parts by weight consisted of: TiC, 50; NiAl, 50, with no other phases present in detectable amounts. The density was measured to be 4.817 $g/cm^3$ or 89.6% of theoretical. The material was found to be very similar to that in Example 1 with a mean TiC particle size of 1.1 microns.

EXAMPLE 5

A mixture of the following composition (in pbw) was prepared with the same reagents as in the examples above: Ti, 39.98, C, 10.02, Ni, 34.25; Al, 15.75. The procedure followed was the same as in the previous examples with the exception that the hydraulic rams were compressed to 13.8 MPa (2000 psi) immediately after ignition.

The resulting product (in pbw) consisted of: TiC, 50; NiAl, 50, with no other phases present in detectable amounts. The density was measured to be 5.01 $g/cm^3$ or 93.1% of theoretical. The material was nearly identical to that in Examples 1 and 4 with a mean TiC particle size of 1.2 microns.

EXAMPLE 6

A mixture of the following composition was prepared with the same reagents as in Example 1: Ti, 39.98; C, 10.02; Ni, 34.25; Al, 15.75. The procedure followed was the same as in Example 1 with the exception that the hydraulic rams were compressed to 27.6 MPa (4000 psi) immediately after ignition.

The resulting product (in pbw) consisted of: TiC, 50; NiAl, 50, with no other phases present in detectable amounts. The density of the product was measured to be 5.35 $g/cm^3$ or 99.5% of theoretical. The material was nearly identical to that in Examples 1, 4, and 5 with a mean TiC particle size of 1.1 microns.

EXAMPLE 7

A mixture of the following composition (in pbw) was prepared with the same reagents as in Example 1: Ti, 39.98; C, 10.02; Ni, 43.36; Al, 6.64. The procedure followed was the same as in Example 1 with the exception that the hydraulic rams were compressed to 6.9 MPa (1000 psi) immediately after ignition.

The resulting product (in pbw) consisted of: TiC, 50; $Ni_3Al$, 50, with no other phases present in detectable amounts. The density of the product was measured to be 5.09 g/cm$^3$ or 87% of theoretical. The material was nearly identical to that in Example 2 with a mean TiC particle size of 1.0 micron.

EXAMPLE 8

A mixture of the following composition (in pbw) was prepared with the same reagents as in Example 1: Ti, 39.98; C, 10.02; Ni, 43.36; Al, 6.64. The procedure followed was the same as in Example 1 with the exception that the hydraulic rams were compressed to 13.8 MPa (2000 psi) immediately after ignition.

The resulting product consisted of TiC, 50; $Ni_3Al$, 50, with no other phases present in detectable amounts. The density of the product was measured to be 5.39 g/cm$^3$ or 92.1% of theoretical. The material was nearly identical to that in Examples 2 and 7 with a mean TiC particle size of 0.9 micron.

EXAMPLE 9

A mixture of the following composition (in pbw) was prepared with the same reagents as in Example 1: Ti, 39.98; C, 10.02; Ni, 43.36; Al, 6.64. The procedure followed was the same as in Example 1 with the exception that the hydraulic rams were compressed to 27.6 MPA (4000 psi) immediately after ignition. The resulting product consisted of TiC, 50; $Ni_3Al$, 50, with no other phases present in detectable amounts. The density of the product was measured to be 5.85 g/cm$^3$ or 100% of theoretical. The material was nearly identical to that in Examples 2, 7, and 8 with a mean TiC particle size of 0.9 micron.

EXAMPLE 10

A mixture of the following composition was prepared with the same reagents as in Example 1: Ti, 69.97; C, 17.53; Ni, 8.56; Al, 3.94. The procedure followed was the same as in Example 1 with the exception that the hydraulic rams were compressed to 20.7 MPa (3000 psi) immediately after ignition.

The resulting product (in pbw) consisted of: TiC, 87.5; NiAl, 12.5, with no other phases present in detectable amounts. The density of the product was measured to be 4.7 g/cm$^3$ or 94.1% of theoretical, and the mean TiC particle size was 9.5 microns.

EXAMPLE 11

A mixture of the following composition (in pbw) was prepared with the same reagents as in Example 1: Ti, 49.98; C, 12.52; Ni, 25.69; Al, 11.81. The procedure followed was the same as in Example 1 with the exception that the hydraulic rams were compressed to 20.7 MPa (3000 psi) immediately after ignition.

The resulting product (in pbw) consisted of TiC, 6.25; NiAl, 37.5, with no other phases present in detectable amounts. The density of the product was measured to be 5.09 g/cm$^3$ or 97% of theoretical, and the mean TiC particle size was 2.9 microns.

EXAMPLE 12

A mixture of the following composition (in pbw) was prepared with the same reagents as in Example 1: Ti, 19.99; C, 5.01; Ni, 51.38; Al, 23.62. The procedure followed was the same as in Example 1 with the exception that the hydraulic rams were compressed to 20.7 MPa (3000 psi) immediately after ignition.

The resulting product (in pbw) consisted of TiC, 25; NiAl, 75, with no other phases present in detectable amounts. The density of the product was measured to be 5.60 g/cm$^3$ or 99.5% of theoretical, and the mean TiC particle size was 0.49 micron.

EXAMPLE 13

A mixture of the following composition (in pbw) was prepared with the same reagents as in Example 1: Ti, 69.97; C, 17.53; Ni, 10.84; Al, 1.66. The procedure followed was the same as in Example 1 with the exception that the hydraulic rams were compressed to 20.7 MPa (3000 psi) immediately after ignition.

The resulting product (in pbw) consisted of TiC, 87.5; $Ni_3Al$, 12.5, with no other phases present in detectable amounts. The density of the product was measured to be 4.84 g/cm$^3$ or 94.6% of theoretical, and the mean TiC particle size was 7.5 microns.

EXAMPLE 14

A mixture of the following composition (in pbw) was prepared with the same reagents as in Example 1: Ti, 59.97; C, 15.03; Ni, 21.68; Al, 3.32. The procedure followed was the same as in Example 1with the exception that the hydraulic rams were compressed to 20.7 MPa (3000 psi) immediately after ignition.

The resulting product (in pbw) consisted of TiC, 75; $Ni_3Al$, 25, with no other phases present in detectable amounts. The density of the product was measured to be 5.07 g/cm$^3$ or 95% of theoretical, and the mean TiC particle size was 4.3 microns.

EXAMPLE 15

A mixture of the following composition (in pbw) was prepared with the same reagents as in Example 1: Ti, 49.98; C, 12.52; Ni, 32.52; Al, 4.98. The procedure followed was the same as in Example 1 with the exception that the hydraulic rams were compressed to 20.7 MPa (3000 psi) immediately after ignition.

The resulting product (in pbw) consisted of TiC, 62.5; $Ni_3Al$, 37.5, with no other phases present in detectable amounts. The density of the product was measured to be 5.52 g/cm$^3$ or 96.5% of theoretical, and the mean TiC particle size was 2.1 microns.

EXAMPLE 16

A mixture of the following composition (in pbw) was prepared with the same reagents as in Example 1: Ti, 19.99; C, 5.01; Ni, 65.04; Al, 9.96. The procedure followed was the same as in Example 1 with the exception that the hydraulic rams were compressed to 20.7 MPa (3000 psi) immediately after ignition.

The resulting product (in pbw) consisted of TiC, 25; $Ni_3Al$, 75, with no other phases present in detectable amounts. The density of the product was measured to be 6.76 g/cm$^3$ or 98.5% of theoretical, and the mean TiC particle size was 0.35 microns.

EXAMPLE 17

A mixture of the following composition (in pbw) was prepared with the same reagents as in Example 1: Ti, 43.98; C, 11.02; Ni, 45. The procedure followed was the same as in Example 1 with the exception that the hydraulic rams were compressed to 20.7 MPa (3000 psi) immediately after ignition.

The resulting product (in pbw) consisted of: TiC, and Ni with no other phases present in detectable amounts. The density of the product was measured to be 5.75 g/cm$^3$ or 93.5% of theoretical.

EXAMPLE 18

A mixture of the following composition (in pbw) was prepared with the same reagents as in Example 1: Ti, 39.98; C, 10.02; Ni, 39.19; Al, 10.81. The procedure followed was the same as in Example 1 with the exception that the hydraulic rams were compressed to 20.7 MPa (3000 psi) immediately after ignition.

The resulting product (in pbw) consisted of: TiC, $Ni_3Al$, and NiAl with no other phases present in detectable amounts. The density of the product was measured to be 5.44 g/cm$^3$ or 97% of theoretical.

EXAMPLE 19

A mixture of the following composition (in pbw) was prepared with the same reagents as in Example 1: Ti, 39.98; C, 10.02; Ni, 29.60; Al, 20.40. The procedure followed was the same as in Example 1 with the exception that the hydraulic rams were compressed to 20.7 MPa (3000 psi) immediately after ignition.

The resulting product (in pbw) consisted of: TiC, $Ni_2Al_3$ with no other phases present in detectable amounts. The density of the product was measured to be 4.36 g/cm$^3$ or 90% of theoretical.

EXAMPLE 20

A mixture of the following composition (in pbw) was prepared with the same reagents as in Example 1: Ti, 39.98; C, 10.02; Ni, 21.02; Al, 38.98. The procedure followed was the same as in Example 1 with the exception that the hydraulic rams were compressed to 20.7 MPa (3000 psi) immediately after ignition.

The resulting product (in pbw) consisted of: TiC, $Ni_2Al_3$, $NiAl_3$ and $TiAl_3$ with no other phases present in detectable amounts. The density of the product was measured to be 4.07 g/cm$^3$ or 92.3% of theoretical.

EXAMPLE 21

A mixture of the following composition (in pbw) was prepared with the same reagents as in Example 1: Ti, 39.98; C, 10.02; Al, 50.00. The procedure followed was the same as in Example 1 with the exception that the hydraulic rams were compressed to 20.7 MPa (3000 psi) immediately after ignition.

The resulting product (in pbw) consisted of: TiC, $TiAl_3$, and Al with no other phases present in detectable amounts. The density of the product was measured to be 3.05 g/cm$^3$ or 87.4% of theoretical.

EXAMPLE 22

A mixture was prepared identical to that in Example 3 with the exception that half of the carbon was added in the form of graphite whiskers. These whiskers were approximately 5 mm long and 10–15 microns in diameter.

The resulting product (in pbw) consisted of: TiC, 75; NiAl, 25, with no other phases present in detectable amounts. The density of the product was measured to be 4.90 g/cm$^3$ or 95.3% of theoretical. The TiC particle size was measured to be 6.1 microns and the microhardness was 1945 kg/mm$^2$. Overall the microstructure of this sample and in Example 3 were nearly identical. There was no evidence of the graphite whiskers ever having been in the reagent mixture. This result suggests that part of the mechanism of this reaction is the dissolution of the carbon into a liquid followed by the precipitation of TiC from this melt.

Modifications of the above described modes for carrying out the invention that are obvious to those of ordinary skill in the fields of combustion synthesis, composite ceramics, refractory materials, and related technologies are intended to be within the scope of the following claims.

What is claimed is:

1. A process for producing a dense composite material, wherein said material comprises one or more finely grained ceramic phase or phases and one or more intermetallic phase or phases, by combustion synthesis comprising the steps of:

(1) selecting at least one element from each of the following groups:
  (a) a group consisting of Ti, Zr, Hf, Ta, Nb, Si and B;
  (b) a group consisting of C and B;
  (c) a group consisting of Ni, Ti and Cu; and
  (d) a group consisting of Al, Ti, Fe and Co;
  with the provisos that if the element selected in group (a) is Si or B that the element of group (b) that is selected is C; that if the element selected from group (c) is Ti then the element selected from group (d) is not Ti; that if nickel is selected in group (c), that either Al or Ti are selected in group (d); and that if Cu is selected from group (c), that Al is selected from group (d);
(2) mixing the elements selected in step (1);
(3) igniting said selected elements; and
(4) applying mechanical pressure during or immediately after the ignition of step (3).

2. A process according to claim 1 wherein the mechanical pressure applied is within the range of from about 20 MPa to about 30 MPa.

3. A process according to claim 1 wherein the element selected from group (a) is Ti; from group (b) is C or B; from group (c) is Ni; and from group (d) is Al.

4. A process according to claim 3 wherein TiC, TiB, $TiB_2$, $Ni_3Al$ and/or NiAl are mixed with the elements in step 2.

5. A process according to claim 4 wherein the percentage range by weight of TiC, TiB and/or $TiB_2$ mixed with the elements is from about 0% to about 20% of the total weight of the ceramic phase formed, and wherein the percentage range by weight of NiAl and/or $Ni_3Al$ mixed with the elements is from about 0% to about 50% of the total weight of the intermetallic phase formed.

6. A process according to claim 1 wherein boron is mixed with the elements in step (2).

7. A process for producing a dense composite material, wherein said material comprises one or more finely grained ceramic phase or phases and one or more metallic phase or phases, by combustion synthesis comprising the steps of:

(1) selecting at least one element from each of the following groups:
  (a) a group consisting of Ti, Zr, Hf, Ta, and Nb;
  (b) a group consisting of C and B;
  (c) a group consisting of Ni, Fe, Co, Al and Cu;
(2) mixing the elements selected in step (1);
(3) igniting said selected elements; and
(4) applying pressure in a range of from about 5 MPa to about 60 MPa during or immediately after the ignition of step (3).

8. A process according to claim 7 wherein group (c) consists of Ni and Fe.

9. A process according to claim 8 wherein group (a) consists of Ti.

10. A process according to claim 8 wherein group (c) consists of Ni.

11. A process according to claim 7 wherein the metal selected in group (c) is at least 15% by weight of all the elements selected.

12. A process for producing a dense composite material by combustion synthesis wherein said material comprises one or more finely grained ceramic phase or phases and one or more intermetallic phase or phases wherein:

(a) the ceramic phase or phases is or are selected from the group consisting of TiC, TiB, $TiB_2$, ZrC, $ZrB_2$, HfC, $HfB_2$, TaC, $TaB_2$, NbC, $NbB_2$, SiC and $B_4C$; and (b) the intermetallic phase or phases is or are selected from the group comprising nickel aluminides, titanium aluminides, copper aluminides, titanium nickelides, titanium ferrides, and cobalt titanides; and wherein said combustion synthesis process comprises the step of applying mechanical pressure during or immediately following ignition.

13. A process according to claim 12 wherein the pressure is applied during or within 25 seconds of ignition.

14. A process according to claim 12 wherein the mechanical pressure applied is within a range of from about 5 MPa to about 60 MPa.

15. A process according to claim 14 wherein the range is from about 10 MPa to about 30 MPa.

16. A process according to claim 15 wherein the range is from about 20 MPa to about 30 MPa.

* * * * *